US005722885A

United States Patent [19]

Matthews

[11] Patent Number: 5,722,885

[45] Date of Patent: Mar. 3, 1998

[54] AIR MOVING SYSTEM

[75] Inventor: Richard D. Matthews, London, Great Britain

[73] Assignees: South Bank University & Enterprises, Limited; Woods of Colchester Limited, both of United Kingdom

[21] Appl. No.: 793,768

[22] PCT Filed: Aug. 23, 1995

[86] PCT No.: PCT/GB95/02002

§ 371 Date: Feb. 24, 1997

§ 102(e) Date: Feb. 24, 1997

[87] PCT Pub. No.: WO96/06313

PCT Pub. Date: Feb. 29, 1996

[30] Foreign Application Priority Data

Aug. 23, 1994 [GB] United Kingdom ..... 9416975

[51] Int. Cl.[6] ..... E21F 1/00

[52] U.S. Cl. ..... 454/167; 454/342

[58] Field of Search ..... 454/167, 166, 454/342, 338

[56] References Cited

U.S. PATENT DOCUMENTS 4,412,478 11/1983 Osher et al. ..... 98/33 R

FOREIGN PATENT DOCUMENTS

| | | |
|---|---|---|
| 0 240 713 | 10/1987 | European Pat. Off. . |
| 0 410 428 A2 | 1/1991 | European Pat. Off. . |
| 1601611 | 10/1970 | France . |
| 411 019 | 10/1966 | Germany . |
| 447 254 | 3/1968 | Germany . |
| 58-193730 | 11/1983 | Japan . |
| 1-275900 | 11/1989 | Japan . |

*Primary Examiner*—Harold Joyce
*Assistant Examiner*—Derek S. Boles
*Attorney, Agent, or Firm*—Kirschstein et al.

[57] ABSTRACT

A jet fan arrangement for ventilating tunnels and the like in which the axis of the fan is positioned at an angle to the supporting surface so as to blow air away from the supporting surface. When the flow of air through the fan is reversed, the angle of inclination of the axis of the fan is automatically changed so that the direction of flow of air remains away from the supporting surface.

18 Claims, 1 Drawing Sheet

AIR MOVING SYSTEM

BACKGROUND OF THE INVENTION

This invention relates to fans and arrangements of fans particularly for use in tunnels and other enclosed spaces where large volumes of air are required to be moved e.g. for ventilation or smoke control.

It is known that jet fans can be used to ventilate underground tunnels. These fans operate by ejecting a jet of high speed air to entrain and move a larger volume of air. This type of fan known as a jet fan is widely used in underground train and road tunnels although they are widely used in other applications e.g. underground car parks.

In use, the fans are normally attached to the wall or ceiling of the area to be ventilated, however under some circumstances including control of smoke from fires or other airborne dangers, (such as a toxic gas leak etc.) the fans must be reversible so that if there were to be an airborne hazard upstream from the fan, reversing the fan would reduce the spread of the hazard. This is particularly so in the case of fire as reversing the fan can help provide an escape route for people away from the fire.

Previously fans have been conventionally mounted with their principle axis, along which air will initially flow, parallel to the supporting surface. It is usual for the supporting surface to be the ceiling or wall of the tunnel or space to be ventilated, where space is limited the fans can be mounted in niches.

The distance between the fan and the supporting surface should be sufficient to reduce the surface effects such as friction arising from the flow of air along the surfaces. Invariably jet fans will be mounted close to the tunnel wall or ceiling to minimise the tunnel cross-sectional area available for vehicle movement.

In some cases baffles or other flow deflecting means are employed to direct the flow of the air in specific directions away from adjacent surfaces but these are cumbersome and can cause energy losses to the flow from the jet fan.

In circular or rectangular section tunnels the primary jet from the fan needs to be directed away from the walls and the ceiling to minimise losses due to wall friction between the primary jet and the solid surfaces.

In cases where the jet fans are mounted in niches the primary jet needs to be directed clear of solid surfaces.

SUMMARY OF THE INVENTION

We have now invented an improved arrangement for such fans.

According to the invention there is provided an air moving system in which a jet fan is positioned adjacent to a surface or surfaces with the axis of the jet fan at an angle to the said supporting surface or surfaces so as to direct air away from the surface when the fan is working, the jet fan being supported on at least one adjustable mounting so that when the direction of the air being blown by the fan is reversed the fan can be adjusted on its mounting so as to direct the said reversed air flow away from the adjacent surface or surfaces in the opposite direction.

Jet fans are widely known and used for various ventilation applications and are made by Woods of Colchester and many other companies. The size of the fan used depends on the size of the space to be ventilated and the pollutant dilution and movement required.

Jet fan applications cover road vehicle tunnels throughout Europe, America, and the Far East with their cost effectiveness making them first choice ahead of transverse or semi-transverse ventilation.

We have found that by directing the flow of air away from the adjacent surface or surfaces increased efficiency of the ventilation system can be obtained.

The angle of inclination of the axis of the fan to the adjacent surface or surfaces will normally be up to 20 degrees, typically 2 to 15 degrees. The optimum angle depends upon the distance of the fan from the supporting surface or surfaces and the surface characteristics and, if niches are employed, niche geometry.

When it is necessary to reverse the flow of air through such an inclined fan, unless the fan's inclination was altered, air would be blown towards the adjacent surface or surfaces, which would not be desirable. This means that the inclination of the fan should be altered so that when the direction of flow through the fan is reversed air is caused to be directed away from the adjacent surface or surfaces It is a feature of our invention that by having a jet fan suspension mechanism which can be operated e.g. electrically, hydraulically, pneumatically or by the jet fan thrust itself to adjust its inclination to adjacent surfaces, a system with optimum ventilation system performance can be achieved with the jet fan operating in either direction.

Preferably the fan is mounted so that, on altering the flow of air through the fan, the inclination of the fan in relation to the supporting surface or surfaces is automatically altered. This can be carded out by the arrangement of the mounting of the fan so that, in its normal operating mode, the fan is in a stable position in the correct alignment in relation to the supporting surface or surfaces. When the flow of air through the fan is reversed, the fan automatically changes its inclination so that the flow of air in this reversed direction is away from the supporting surface or surfaces.

This change of inclination can be caused by the effect of the thrust of the air flow acting in conjunction with the position and arrangement etc. of the mountings or by the activation of a separate means to change the configuration of the fan. Preferably in its reversed position the fan is stable so that no further adjustment is required. When the change in the inclination of the fan is caused largely or solely by the action of the reverse thrust of the air flow through the fan, the fan can be held in each of its two inclinations by the weight of the fan acting in conjunction with appropriate stops etc. If required additional assistance in reversing the inclination of the fan and in holding the fan in position can be provided by springs or other mechanical means, this can enable a more positive switch from the normal operating inclination of the fan to its reverse position to take place.

In one embodiment of the invention the fan is mounted on a fan support framework which is attached to the wall or ceiling of the ventilated space. The fan suspension system can be built into the fan support framework and contains an arrangement whereby the angle of the fan away from the wall or ceiling can be changed and allow the fan to take up attitudes with the axis of the fan inclined at different angles to the supporting walls or ceiling.

The system can be electrically, pneumatically or hydraulically powered or can involve over centring levers, with or without spring assistance depending on the thrust to weight ratio of the jet fan and whether the fan is mounted on a ceiling or a wall. The fan suspension system can include a simple sliding arrangement and the jet fan may translate in, or rotate about one or all of three orthogonal axes during the system operation and in response to the reverse flow mode.

BRIEF DESCRIPTION OF THE DRAWINGS

The invention will now be described with reference to the accompanying drawings in which.

DETAILED DESCRIPTION OF THE PREFERRED EMBODIMENTS

Figure 1:
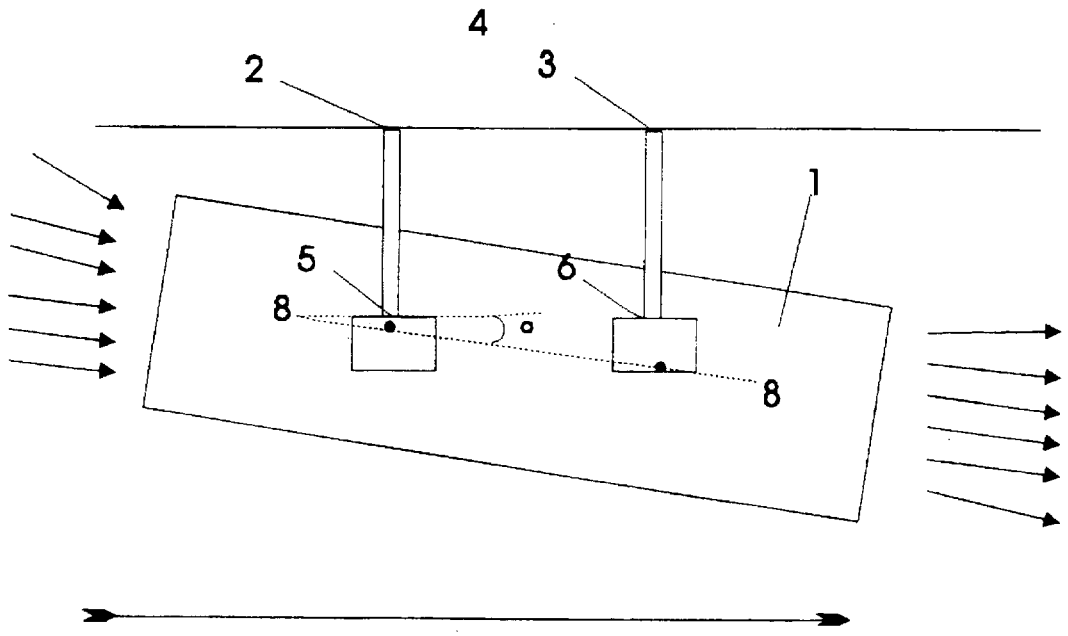
FIGS. 1 and 2 are a Schematic drawing of a fan utilising the present invention in two alterative positions.

Referring to the drawings in FIG. 1 in which the fan is shown operating in its normal configuration with the direction of flow shown by the arrows. A jet fan (1) has its suspension framework attached to the ceiling (4). The fan (1) is attached to the suspension framework via the fan suspension system at (5) and (6). When the fan is turned on the fan blows air out in the direction shown by the arrows in FIG. 1 and the fan is held in position by an adjustable stop (not shown) which prevents the fan from moving any further, the weight of the fan holding it in position when the fan is turned off.

The axis of the fan is along the line 8—8 and is at an angle (a) to the ceiling.

Figure 2:
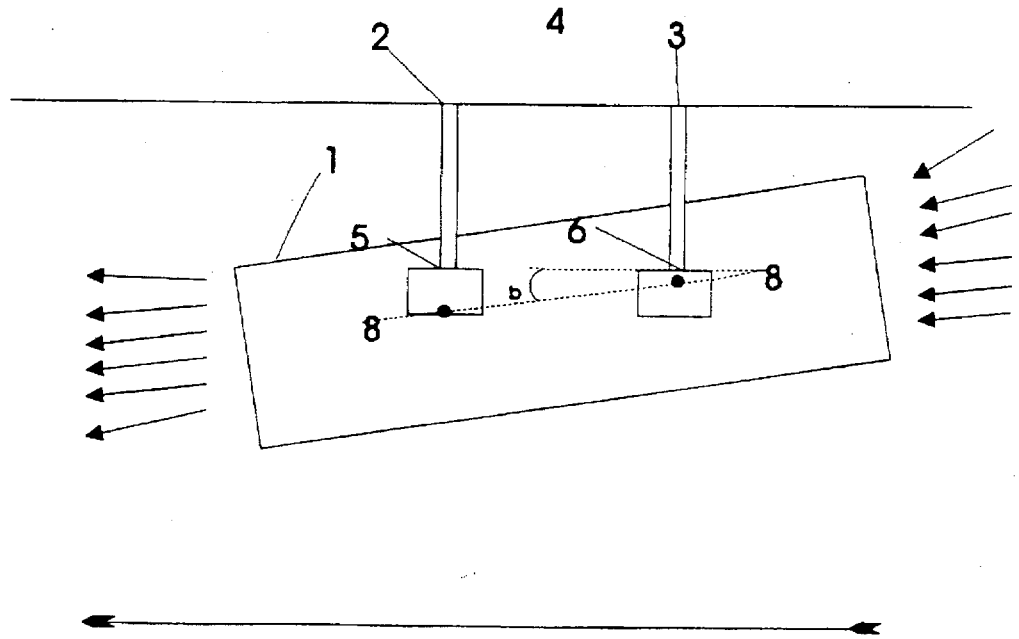

When the fan is reversed the jet fan thrust can "toggle" the fan into the position shown in FIG. 2 with the air direction the shown by the arrows. The axis of the jet fan shown by the line 8—8 is now at an angle (b) to the ceiling.

The angles (a) and (b) can be the same or different depending on the position downstream or upstream of solid surfaces or other ventilation requirements.

Instead of being activated by the thrust of the fan the appropriate inclination of the fan can be achieved electrically by sensing the switching of the fan's direction and using this to excite a solenoid to move the fan.

Alternatively hydraulic or pneumatic actuation can be used to change the inclination of the fan's axis.

The efficiency of jets fans in a circular section tunnel at various inclinations of the fan's axis to the ceiling are shown in the Table.

TABLE

| Pitch Angle of Fan Degrees | Ventilation System Efficiency |
|---|---|
| 0 | 81% |
| 5 | 92% |
| 10 | 97% |
| 15 | 94% |
| 20 | 90% |

I claim:

1. An air moving system, comprising: a jet fan having an axis and positioned adjacent to a supporting surface with the axis of the jet fan in a first position at an angle to said supporting surface so as to direct air away from the supporting surface when the fan is working, the jet fan being supported on at least one adjustable mounting so that, when the direction of air being blown by the fan is reversed, the fan is adjusted on its mounting to a second position so as to direct said reversed air flow away from said supporting surface in the opposite direction to the direction in the first position.

2. The air moving system as claimed in claim 1 in which the angle of inclination of the axis of the fan in the first position to said supporting surface is less than twenty degrees.

3. The air moving system as claimed in claim 2 in which the angle of inclination of the axis of the fan in the first position to said supporting surface is from two to fifteen degrees.

4. The air moving system as claimed in claim 1 in which the fan is mounted on at least two spaced fan suspension systems.

5. The air moving system as claimed in claim 1 in which the direction of inclination of the fan in relation to the supporting surface is automatically altered when the direction of flow of air through the fan is reversed.

6. The air moving system as claimed in claim 5 in which the direction of inclination of the fan is changed by the change in the direction of the thrust generated by reversing the direction of the flow of air through the fan.

7. The air moving system as claimed in claim 6 in which there are springs positioned to assist in the change of inclination of the fan and its location in its operating position.

8. The air moving system as claimed in claim 5, 6, or 7 in which there are direction changing means to change or assist in the change of inclination of the fan.

9. The air moving system as claimed in claim 5, 6, or 7 in which the direction changing means are pneumatically, electrically or hydraulically operated.

10. An air moving system, comprising: a jet fan having an axis and positioned adjacent to a supporting surface with the axis of the jet fan in a first position at an angle to said supporting surface so as to direct air away from said supporting surface when the fan is working, the jet fan being supported on at least one adjustable mounting so that, when the direction of air being blown by the fan is reversed, the fan is adjusted on its mounting to a second position so as to direct said reversed air flow away from said supporting surface in the opposite direction to the direction in the first position, and wherein the angle of inclination of the axis of the fan in the first position to said supporting surface is from two to fifteen degrees.

11. The air moving system as claimed in claim 10 in which the fan is mounted on at least two spaced fan suspension systems.

12. The air moving system as claimed in claim 11 in which the direction of inclination of the fan in relation to said supporting surface is automatically altered when the direction of flow of air through the fan is reversed.

13. The air moving system as claimed in claim 12 in which the direction of inclination of the fan is changed by the change in the direction of the thrust generated by reversing the direction of flow of air through the fan.

14. The air moving system as claimed in claim 13 in which there are springs positioned to assist in the change of inclination of the fan and its location in its operating position.

15. The air moving system as claimed in claim 14 in which there are direction changing means to change or assist in the change of inclination of the fan.

16. The air moving system as claimed in claim 13 in which the direction changing means are pneumatically, electrically or hydraulically operated.

17. An air moving system, comprising: a jet fan having an axis and positioned adjacent to a supporting surface with the axis of the jet fan in a first position at an angle to said supporting surface so as to direct air away from said supporting surface when the fan is working, the jet fan being supported on at least one adjustable mounting so that, when the direction of air being blown by the fan is reversed, the fan is adjusted on its mounting to a second position so as to direct said reversed air flow away from said supporting surface in the opposite direction to the direction in the first position, said angle of inclination of the axis of the fan in the first position to said supporting surface being from two to fifteen degrees, said fan being mounted on at least two spaced fan suspension systems, the direction of inclination of the fan in relation to said supporting surface being automatically altered when the direction of the flow of air through the fan is reversed, the direction of inclination of the fan being changed by the change in the direction of the thrust generated by reversing the direction of the flow of air through the fan, springs positioned to assist in the change of inclination of the fan and its location in its operating position, and direction changing means for changing and assisting in the change of inclination of the fan.

18. The air moving system as claimed in claim 17 in which the direction changing means are pneumatically, electrically or hydraulically operated.

* * * * *